US008822742B2

(12) United States Patent
Poirier et al.

(10) Patent No.: US 8,822,742 B2
(45) Date of Patent: Sep. 2, 2014

(54) METHOD FOR INCREASING COLOR QUALITY AND STABILITY OF FUEL

(75) Inventors: Marc-Andre Poirier, Sarnia (CA); Ashok Uppal, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 12/946,267

(22) Filed: Nov. 15, 2010

(65) Prior Publication Data

US 2011/0131870 A1 Jun. 9, 2011

Related U.S. Application Data

(60) Provisional application No. 61/283,486, filed on Dec. 4, 2009.

(51) Int. Cl.

| | |
|---|---|
| ***C10L 1/00*** | (2006.01) |
| ***C10L 1/16*** | (2006.01) |
| ***B01D 15/04*** | (2006.01) |

(52) U.S. Cl.

USPC ..... 585/14; 210/669; 208/209

(58) Field of Classification Search

USPC ..... 210/198.2, 656, 660, 668, 669, 263; 208/189, 209; 585/1, 14; 44/300, 435, 44/459

See application file for complete search history.

(56) References Cited

U.S. PATENT DOCUMENTS

| | | | | |
|---|---|---|---|---|
| 2,267,458 | A | 12/1941 | Goldsby | |
| 2,853,432 | A | 9/1958 | Gleim et al. | |
| 3,378,484 | A | 4/1968 | Ferrara et al. | |
| 3,445,380 | A | 5/1969 | Urban | |
| 3,487,012 | A | 12/1969 | Plummer et al. | |
| 3,574,093 | A | 4/1971 | Strong | |
| 3,923,645 | A | 12/1975 | Anderson, Jr. et al. | |
| 4,098,681 | A | 7/1978 | Carlson | |
| 4,382,124 | A | 5/1983 | Meitzner et al. | |
| 4,383,916 | A * | 5/1983 | Gutberlet et al. | 208/189 |
| 4,775,462 | A * | 10/1988 | Imai et al. | 208/189 |
| 4,906,354 | A | 3/1990 | Barry et al. | |
| 4,912,873 | A | 4/1990 | Diaz et al. | |
| 5,334,308 | A * | 8/1994 | Graiff et al. | 208/299 |
| 6,551,501 | B1 | 4/2003 | Whitehurst et al. | |
| 7,223,332 | B1 * | 5/2007 | Tertel | 208/208 R |
| 2006/0156620 | A1 | 7/2006 | Clayton et al. | |

FOREIGN PATENT DOCUMENTS

| | | |
|---|---|---|
| CN | 1583964 | 2/2005 |

OTHER PUBLICATIONS

Amberlyst 15 Product Information Sheet Rohm Haas.*
ExxonMobil World Jet Fuel Specifications 2005.*
Amberlyst 15 Product Information Sheet Rohm Haas (no date—but avail in 1994).*
Exxon Mobil Word Jet Fuel Specifications 2006.*
Michael E. Prudich, Donald C. Cronauer, Roger F. Vogel, Jeffrey Solash; "Shale Oil Denitrogenation with Ion Exchange. 1. Process Concept and Modeling," Ind. Eng., Chem, Process Des. Dev., 1986, 25, 742-748.
George Marcelln, Donald C. Cronauer, Roger F. Vogel, Michael E. Prudich, Jeffrey Solash; "Shale Oil Denitrogenationation with Ion Exchange. 2. Evaluation of Ion-Exchange Adsorbents and Resin Treatment Procedures," Ind. Eng. Chem. Process Des. Dev., 1986, 25, 747-758.
Hemighaus, Greg et al., "Aviation Fuels Technical Review", 2006, Chevron Corporation.
Hazlett, R. N., "Thermal Oxidation Stability of Aviation Turbine Fuels", ASTM Publication Code No. 31-001092-12, 1991.
Schwartz, F. G., Eccleston, B. H., "Survey of Research on Thermal Stability of Petroleum Jet Fuels", BuMines Information Circular 8140, Bureau of Mines, Washington, DC.

* cited by examiner

*Primary Examiner* — Pamela H Weiss
(74) *Attorney, Agent, or Firm* — Chad A. Guice; Bruce M. Bordelon

(57) ABSTRACT

This invention relates to process for increasing color quality and thermal stability of fuel. Fuel that is provided as a feedstock is contacted or treated with an acidic, ion-exchange resin to increase the color quality and stability of the fuel. The process provides the benefit of substantially increasing the long term quality of both color and oxidation (JFTOT) stability.

11 Claims, No Drawings

METHOD FOR INCREASING COLOR QUALITY AND STABILITY OF FUEL

This Application claims the benefit of U.S. Application No. 61/283,486, filed Dec. 4, 2009, which is hereby incorporated by reference herein in its entirety.

FIELD OF THE INVENTION

This invention relates to a process for increasing color quality and thermal stability of fuels. In particular, this invention relates to a process for increasing color quality and thermal stability of fuel in which a fuel feedstock is contacted with an acidic, ion-exchange resin to increase the color quality and thermal stability of the fuel feedstock.

BACKGROUND OF THE INVENTION

Over time, the quality of various fuels can degrade. Color quality is one characteristic of a fuel that can degrade over time during storage. Thermal oxidation stability is another.

Robert N. Hazlett, "Thermal Oxidation Stability of Aviation Turbine Fuels," ASTM Publication Code Number 31-001092-12, 1991, reports a process that was considered effective in improving jet fuel thermal oxidation stability.

Schwartz, F. G., and Eccleston, B. H., "Survey of Research on Thermal Stability of Petroleum Jet Fuels," BuMines Information Circular 8140, Bureau of Mines, Washington, D.C., 1962, reports that sulfur dioxide ($SO_2$) extraction, acid treating, and absorption methods improve the thermal stability of jet fuel. with sulfuric acid, caustic, or $SO_2$ have waste disposal problems. The use of absorption methods with agents such as silica gel or alumina have met with marginal success. Clay adsorption generally requires large quantities of material.

Statutory Invention Registration No. U.S. H1368 describes a method for improving the long-term color stability of jet fuel and jet fuel blends containing nitrogen compounds by intimately mixing the jet fuel with a quantity of concentrated sulfuric acid sufficient to remove at least 90% of the nitrogen compounds during contact time equal to or less than 5 minutes; separating the jet fuel from the concentrated sulfuric acid; mixing the jet fuel with an aqueous caustic solution to remove residual acid from the jet fuel; separating the jet fuel from the aqueous caustic solution; mixing the jet fuel with water; and separating the jet fuel from the water.

U.S. Pat. No. 4,912,873 relates to the treatment of diesel or jet fuel with a non-ionic, macro-reticular, cross-linked, acrylic aliphatic ester resin such as XAD-7 that reduces polar impurities and diesel color. The diesel or jet fuel samples are analyzed by the "floc test" which measures the amount of floc visually observed on contact with an aqueous iron solution containing 5 mM ferric sulfate in 5 mM sulfuric acid.

U.S. Pat. No. 2,267,458 relates to a process for refining hydrocarbon oil containing objectionable sulfur, color, and gum-forming compounds. The process comprises subjecting the oil to treatment with used sulfuric acid, which has been obtained from the alkylation of isoparaffins with olefins in the presence of strong sulfuric acid, whereby such objectionable compounds are substantially removed.

U.S. Pat. No. 3,487,012 relates to a process for the improvement of initial color and long-term color stability of aromatic concentrates. The process is considered to improve both initial color and long-term color stability of aromatic concentrates boiling between 400 to 750° F. without substantially reducing the aromaticity. The process comprises hydrotreating, acid treating followed by caustic washing, and vacuum distilling the aromatic concentrates at 5-250 mmHg absolute pressure with corresponding temperatures from 150° F. to 650° F.

Additional methods of enhancing color quality and stability of fuels are needed. In particular, more simple processes using more readily available materials as catalysts to assist in such processing are highly desired.

SUMMARY OF THE INVENTION

This invention provides a relatively simple method for improving the color quality and thermal stability of fuels, particularly jet fuels. In particular, the invention uses a single catalyst to treat fuel material and provide a fuel product having substantially improved color quality and thermal stability. The product is particularly stable over a relatively long period of time.

According to one aspect of the invention, there is provided a process for increasing color quality and thermal stability of fuel. The process comprises providing a fuel, such as diesel, kerosene, jet fuel or a combination thereof, and contacting the fuel with an acidic, ion-exchange resin to increase the color quality and thermal stability of the fuel.

In one embodiment, the acidic, ion-exchange resin comprises a sulfonic or phosphoric ion-exchanged resin. Preferably, the acidic, ion-exchange resin comprises a macro-reticular ion-exchange resin.

In another embodiment, the acidic, ion-exchange resin comprises a copolymer of styrene and divinylbenzene, e.g., a cross-linked styrene-divinylbenzene copolymer.

In another embodiment, the acidic, ion-exchange resin can have a concentration of acidic ion-exchange groups of at least about 1 milli-equivalent $H^+$ per gram dry resin.

In one embodiment, the provided fuel can exhibit a pressure drop of at least about 20 mmHg, according to ASTM D3241.

In another embodiment, the provided fuel can contact the acidic, ion-exchange resin at an average LHSV from about 0.1 $hr^{-1}$ to about 10 $hr^{-1}$.

In a specific embodiment, the provided fuel is jet fuel. The provided fuel can also be described, in one embodiment, as a fuel having an ASTM D86 10% boiling point in the range from about 110° C. to about 190° C., and an ASTM D86 90% boiling point from about 200° C. to about 290° C. Preferably, the provided fuel has a Saybolt color of not greater than 20.

In yet another embodiment, the provided fuel can be contacted with an acidic, ion-exchange resin at a temperature from about 10° C. to about 100° C. to increase the color quality and thermal stability of the fuel.

In another embodiment, the provided fuel can be treated to reduce mercaptan content prior to contact with the acidic, ion-exchange resin. Preferably, the mercaptan-reduced fuel can be water washed prior to contact with the acidic, ion-exchanged resin. Additionally or alternately, the provided fuel can be treated with an alkaline composition in the presence of a mercaptan oxidation catalyst to produce a mercaptan-reduced product, which can then be contacted with the acidic, ion-exchanged resin.

DETAILED DESCRIPTION OF THE INVENTION

This invention provides a process for increasing color quality and thermal stability of fuel. Fuel that is provided as a feedstock can be contacted or treated with an acidic, ion-exchange resin to increase the color quality and thermal stability of the fuel. The process provides the benefit of substantially increasing the long term quality both in color (e.g., in terms of Saybolt color) and in thermal oxidation (JFTOT) stability of the fuel treated according to the process. According to this invention, the thermal stability or JFTOT stability is determined according to ASTM D3241-09, Standard Test Method for Thermal Oxidation Stability of Aviation Turbine Fuels, at about 275° C.

Feedstock Fuel Composition

The fuel that is provided as feedstock or that can be treated according to this invention can include or be any one or more of kerosene, jet fuel, and diesel grades of fuel, including mixtures within or overlapping the particular boiling ranges of each indicated fuel. The invention is particularly suited to producing jet fuel grades. Boiling point ranges are preferably determined according to ASTM D86-09, Standard Test Method for Distillation of Petroleum Products at Atmospheric Pressure.

In one embodiment, the fuel or feedstock treated according to this invention can have an initial and a final boiling point within the range from about 90° C. to about 360° C., preferably from about 100° C. to about 340° C., for example from about 110° C. to about 320° C. or from about 120° C. to about 300° C.

In one embodiment, the process can be carried out by treating or contacting a feedstock fuel having an ASTM D86 10% distillation point within the range from about 110° C. to about 190° C., preferably from about 115° C. to about 180° C., for example from about 120° C. to about 160° C. Additionally or alternately, the process can be carried out by treating or contacting a feedstock fuel having an ASTM D86 90% distillation point within the range from about 200° C. to about 290° C., preferably from about 210° C. to about 280° C., for example from about 220° C. to about 270° C.

Ion-Exchange Resin

An ion-exchange resin generally has an insoluble polymeric matrix containing ions capable of exchanging with ions in the surrounding medium. Ion-exchange resins are typically grouped in four general categories, i.e., strong acid, weak acid, strong base and weak base. In the process according to the invention, acid ion-exchange resins are used. Preferably, strong acid ion-exchange resins are used. Examples of strong acid ion-exchange resins can include resins with sulfonic or phosphonic ion-exchange groups. Exchange resins with sulfonic ion-exchange groups are preferred. Examples of weak acid ion-exchange resins can include resins with carboxylic groups.

In a preferred embodiment of the invention, the ion-exchange resin can have a concentration of acidic ion-exchange groups corresponding to at least 1 milli-equivalent of $H^+$ per gram dry resin, for example at least 3 milli-equivalents of $H^+$ per gram dry resin.

In one embodiment of the invention, the ion-exchange resin can include or can be a macro-reticular ion-exchange resin. Macro-reticular ion-exchange resins typically comprise two continuous phases, i.e., a continuous pore phase and a continuous polymeric phase. The polymeric phase can be structurally composed of small spherical microgel particles agglomerated together to form clusters, which in turn can be fastened together at their interphases to form an interconnecting pore network. Macro-reticular ion-exchange resins useful in this invention can be contrasted with gel-type resins, which do not have permanent pore structures. The non-permanent pores in gel-type ion-exchange resins are usually referred to as gelular pores or molecular pores.

Suitable macro-reticular ion-exchange resins can generally have an average pore diameter in the range from about 1 nm to about 1000 nm, typically from about 10 nm to about 100 nm. Pore size can preferably be measured in the wet state, e.g., using nitrogen BET.

The macroporous polymers that can be used according to this invention can typically be produced by suspension polymerization, and can possess specific surface areas from about 5 $m^2/g$ to about 2000 $m^2/g$, preferably from about 10 $m^2/g$ to about 1200 $m^2/g$, for instance from about 50 $m^2/g$ to about 200 $m^2/g$. As one example, the macroporous polymers can be of the type described in U.S. Pat. No. 4,382,124 (hereby incorporated by reference), in which porosity is introduced into copolymer beads by suspension-polymerization in the presence of a porogen (also known as "phase extender" or "precipitant"). A porogen can be considered a solvent for the monomer but a non-solvent for the polymer.

Monomers that can be used in the ion-exchange resin polymers of this invention can advantageously include polyvinylaromatic monomers. Examples of such monomers include, but are not limited to, divinylbenzenes, trivinylbenzenes, divinyltoluenes, divinylnaphthalenes, divinylanthracenes, divinylxylenes, and the like, and combinations thereof. One preferred monomer includes divinylbenzene. It should be understood that more than one type of monomer can be used in the resin polymer(s), and that such monomers having more than one polymerizable site can be considered as imparting crosslinking to the resulting polymer.

In an embodiment, the ion-exchange resin polymer can comprise from about 50% to about 100% polyvinylaromatic monomer repeat units, preferably from about 65% to about 100%, for example from about 75% to about 100%.

The resin polymers useful in this invention may also comprise mono-vinylaromatic monomers. Examples of mono-vinylaromatic monomers can include, but are not limited to, styrene, alpha-methylstyrene, ($C_1$-$C_4$) alkyl-substituted styrenes, halo-substituted styrenes (such as bromostyrene, dibromostyrenes, and tribromostyrenes), vinylnaphthalene, vinylanthracene, and the like, and combinations thereof. Styrene and/or ($C_1$-$C_4$) alkyl-substituted styrenes can be preferred mono-vinylaromatic monomers. Examples of suitable ($C_1$-$C_4$) alkyl-substituted styrenes can include, but are not limited to, ethylvinylbenzenes, vinyltoluenes, diethylstyrenes, ethylmethylstyrenes and dimethylstyrenes. When mono-vinylaromatic monomers are present in the resin, the resin polymer can be comprised of up to about 50% mono-vinylaromatic monomer repeat units. Typically, when present, the resin polymer can be comprised of up to about 35%, for example up to about 25%, mono-vinylaromatic monomer repeat units. In one embodiment, the ion-exchange functional groups (e.g., sulfonic acid, phosphonic acid, sulfonate, phosphonate, or the like) can be present on at least a portion of the monomers prior to polymerization. Additionally or alternately, the ion-exchange functional groups can be added to at least a portion of the monomer repeat units in a post-polymerization (e.g., sulfonation and/or phosphonation) process.

In a preferred embodiment, the ion-exchange resin can comprise or can be a copolymer of at least one mono-vinylaromatic monomer and at least one polyvinylaromatic monomer. In a particularly preferred embodiment, the resin can comprise or can be a co-polymer of styrene and divinylbenzene, e.g., a cross-linked styrene-divinylbenzene copolymer. Styrene-divinylbenzene copolymers are available commercially from a variety of sources, e.g., from Rohm & Haas under the trade name Amberlyst®. Numerous grades of Amberlyst® resins having $SO_3H$ functional groups may be used, including but not limited to Amberlyst® 131, Amberlyst® 15, Amberlyst® 16, Amberlyst® 31, Amberlyst® 33, Amberlyst® 35, Amberlyst® 36, Amberlyst® 39, Amberlyst® 40, Amberlyst® 70, and the like, and combinations thereof. The Amberlyst® resins can preferably be activated prior to use. The activation can be achieved by contacting the resin with water followed by rinsing with a water miscible solvent.

The resins that are effective according to this invention can generally exhibit a total porosity from about 0.7 $cm^3/g$ to about 2 $cm^3/g$, for example from about 0.9 $cm^3/g$ to about 1.8 $cm^3/g$ or from about 1.0 $cm^3/g$ to about 1.7 $cm^3/g$.

In the process according to the invention, the ion-exchange catalyst can be arranged in any manner effective for increasing color quality and thermal stability of the material being treated. For example, the catalyst can be arranged as a fixed bed of particles or as dispersed particles.

The process can be carried out using any equipment suitable for contact. For example, the process can be carried out as a batch, semi-batch, or continuous process using equipment appropriately suited for such processes.

Temperature

The process according to the invention can typically be carried out at a temperature effective for the resin to significantly affect (improve) color quality and thermal stability of the material being treated. Preferably, the process can be carried out at a temperature of at least about 10° C., for example from about 10° C. to about 100° C. or from about 15° C. to about 80° C.

In general, the upper temperature limit can primarily depend on the temperature-resistance of the catalyst used. For example, in one embodiment in which a crosslinked styrenic ion-exchange resin is used, it can be preferred that the temperature not be greater than about 80° C. In such embodiment, a temperature in the range from about 15° C. to about 50° C. can be particularly preferred.

Pressure

The pressure at which the feedstock or provided fuel is contacted with the catalyst can generally be considered relatively low pressure. Preferably, the process is carried out at an average pressure from about 1 atm to about 10 atm (about 0.1 MPaa to about 1 MPaa), for example from about 1 atm to about 5 atm (about 0.1 MPaa to about 0.5 MPaa).

Feed Rate

The provided feedstock or fuel can preferably be provided in a continuous process system, so as to contact the resin at a rate effective for enhancing the color quality and thermal stability of the fuel. In one embodiment, the feed can be provided at an average liquid hourly space velocity (LHSV) from about 0.1 $hr^{-1}$ to about 10 $hr^{-1}$, for example from about 0.1 $hr^{-1}$ to about 5 $hr^{-1}$.

Color Quality

Color quality of certain fuels can be considered an important quality because, in certain cases, fuel color can be an indication of the degree of the refinement of the composition. For example, when color is outside of an established standard range, this can be an indication of possible product contamination. According to this invention, color quality can also be referred to as Saybolt color and can be determined using ASTM D156-07, Standard Test Method for Saybolt Color of Petroleum Products (Saybolt Chromometer Method).

The process of this invention is capable of increasing Saybolt color quality of the feedstock/fuel being treated by at least about 10%, preferably by at least about 20%, for example by at least about 30%.

The process can be effective to treat fuel type materials that initially have Saybolt color below fuel use specifications. Preferably, the process can be carried out by contacting a fuel material with the acidic, ion-exchange resin in which the fuel to be treated has an initial Saybolt color of not greater than 20, preferably not greater than 19, for example not greater than 18 or not greater than 15.

The fuel treated according to this invention can preferably be contacted or treated with the acidic, ion-exchange resin to provide a treated fuel having a Saybolt color of at least 20, preferably at least 22, for example at least 24, at least 26, or at least 27.

Fuel Thermal Stability

This invention can also provide the benefit of substantially enhancing fuel thermal stability, which can be determined in this invention according to JFTOT (i.e., ASTM D3241-09, Standard Test Method for Thermal Oxidation Stability of Aviation Turbine Fuels, a.k.a. the JFTOT procedure, at about 275° C.). JFTOT test results, which include pressure-based and color-based test results, can be indicative of fuel performance during gas turbine operation and can be used to assess the level of deposits that can form when liquid fuel contacts a heated surface at a specified temperature. The greater the pressure drop (i.e., $\Delta P$), according to the JFTOT procedure, the poorer stability of the fuel. Deposit color rating, according to the JFTOT procedure, can also be an indication of fuel quality.

In one embodiment, the process of this invention increases stability by reducing pressure drop in treated fuel by at least about 10%, preferably by at least about 20%, for example by at least about 30%, relative to the fuel prior to treatment and according to ASTM D3241-09.

It can be preferred to treat fuels according to this invention that have relatively high pressure drops according to the JFTOT procedure. In an embodiment of the invention, the fuel provided for treatment can have an initial pressure drop of at least about 15 mmHg, according to ASTM D3241-09. The process of the invention is particularly effective on fuels having high pressure drop, e.g., an untreated pressure drop of at least about 20 mmHg, such as at least about 25 mmHg, according to ASTM D3241-09.

JFTOT pressure drop of the product produced according to the invention can generally meet a wide variety of fuel specifications. In one embodiment, the provided fuel can be contacted or treated with the acidic, ion-exchange resin to produce a fuel product having a pressure drop not greater than about 15 mmHg, preferably not greater than about 12 mmHg, for example not greater than about 10 mmHg, not greater than about 5 mmHg, or not greater than about 2 mmHg, according to ASTM D3241-09.

JFTOT tube deposit of the product produced according to the invention, as defined by color or tube deposit rating according to ASTM D3241-09, can also meet a wide variety of fuel specifications. In one embodiment, the provided fuel can be contacted or treated with the acidic, ion-exchange resin to produce a fuel product having a tube deposit rating of not greater than 4, preferably not greater than 3, for example not greater than 2.

Mercaptan Removal

In one embodiment of the invention, the provided fuel or fuel to be treated can be contacted or treated to reduce or remove mercaptan content prior to treatment with acidic, ion-exchange resin. In a particular embodiment, the mercaptan content can be reduced or removed by converting at least a portion of the mercaptan to disulfides. This type of conversion can be accomplished, e.g., by treating with caustic in the presence of a mercaptan oxidation catalyst.

In a particular embodiment of the invention, produced or provided fuel having color quality and stability below a predetermined or set level can be contacted or treated with an alkaline/caustic composition in the presence of a mercaptan oxidation catalyst to reduce mercaptan content, thus forming a mercaptan-reduced product, which can then be contacted or treated with the acidic, ion-exchange resin to increase the color quality and stability of the mercaptan-reduced product, thus forming fuel of increased or predetermined color quality and stability.

Another aspect of the invention can be described as a process for treating hydrocarbons, which process comprises the steps of passing an oxygen-containing gas (e.g., air), an aqueous alkaline composition, and a feedstream comprising (i) mercaptans and (ii) a hydrocarbon fuel type composition into an oxidation zone to form a product reduced in mercaptans. In one embodiment of this aspect, a substantial portion of the mercaptans in the hydrocarbon can advantageously be converted to disulfides. The mercaptan-reduced hydrocarbon can then be contacted or treated with the acidic, ion-exchanged resin to produce a fuel product having enhanced color quality and stability.

In one embodiment, the product from the oxidation zone can be sent to a separation unit, where at least a portion of the aqueous alkaline composition can be separated from the mercaptan-reduced hydrocarbon component. This mercaptan-reduced hydrocarbon can then be further contacted or treated with the acidic, ion-exchanged resin. Preferably, the mercaptan-reduced hydrocarbon or fuel can be water washed prior to contact or treatment with the acidic, ion-exchanged resin.

A mercaptan oxidation catalyst is preferably employed in the oxidation zone. This catalyst can be supported on a bed of inert solids retained within the oxidation zone, and/or it can be dispersed or dissolved in the aqueous alkaline solution. Any suitable mercaptan oxidation catalyst can be employed. One example is described in U.S. Pat. No. 3,923,645 (hereby incorporated by reference)—a catalyst comprising a metal compound of tetrapyridinoporphyrazin retained on an inert granular support. Another example of such a catalyst can be a metallic phthalocyanine, such as described in U.S. Pat. Nos. 2,853,432, 3,445,380, 3,574,093, and/or 4,098,681, each of which are hereby incorporated by reference. The metal of the metallic phthalocyanine can include one or more of titanium, zinc, iron, manganese, cobalt, and vanadium, but is preferably either cobalt or vanadium. The metal phthalocyanine can also be employed as a derivative compound, examples of which include, but are not limited to, cobalt phthalocyanine monosulfonate, cobalt phthalocyanine disulfonate, and the like.

When the mercaptan oxidation catalyst is used in its supported form, an inert absorbent carrier material can preferably be employed, e.g., in the form of tablets, extrudates, spheres, or randomly-shaped naturally-occurring pieces. Natural materials such as clays, silicates, and/or refractory inorganic oxides can comprise the support material. Additionally or alternately, the support can be formed from diatomaceous earth, attapalgite clay, kieselguhr, kaolin, alumina, zirconia, or the like, or a combination thereof. The active mercaptan oxidation catalytic material can be added to the support in any suitable manner, such as through impregnation by dipping, followed by drying. The catalyst can also be formed in situ within the oxidation zone. In one embodiment, the finished catalyst can contain from about 0.1 wt % to about 10 wt % of a metal phthalocyanine, based on total weight of the finished catalyst.

In one particular embodiment of the invention, an aqueous alkaline solution can be admixed with the hydrocarbon stream that contains the mercaptan, and then both the oxygen-containing gas and the admixture can be passed through a fixed bed of the oxidation catalyst. A preferred alkaline reagent comprises a solution of an alkaline metal hydroxide such as sodium hydroxide, generally referred to as caustic, or potassium hydroxide. Sodium hydroxide can be used in concentrations from about 1 wt % to about 40 wt % (typically in aqueous solution), with a preferred concentration range being from about 1 wt % to about 25 wt %. Any other suitable alkaline material can be employed if desired. The rate of oxygen addition can be set based on the mercaptan content of the hydrocarbon feed stream to the oxidation zone. The rate of oxygen addition can preferably be greater than the amount required to oxidize all of the mercaptans contained in the feed stream, with oxygen feed rates of about 110% to about 220% of the stoichiometrically required amount being preferred. The use of a packed bed contacting zone can be preferable in the oxidation zone. Perforated plates, channeled mixers, inert packing, and/or fibers can be used to provide turbulence. Contact times in the oxidation zone can be chosen to be approximately equivalent to an LHSV (based on hydrocarbon charge) of about 1 $hr^{-1}$ to about 70 $hr^{-1}$. The oxidation zone can be maintained at a temperature of at least about 50° F. (about 10° C.), and typically not greater than about 300° F. (about 149° C.). The pressure in the contacting zone can generally be above atmospheric pressure, preferably greater than about 50 psig (about 340 kPag).

Additionally or alternately, the present invention can include one or more of the following embodiments.

Embodiment 1. A process for increasing color quality and thermal stability of fuel, comprising: providing the fuel, wherein the fuel is diesel, kerosene, jet fuel, or a combination thereof; and contacting the fuel with an acidic, ion-exchange resin to increase the color quality and thermal stability of the fuel.

Embodiment 2. The method of embodiment 1, wherein the acidic, ion-exchange resin comprises or is a sulfonic or phosphonic ion-exchanged resin.

Embodiment 3. The method of embodiment 1 or embodiment 2, wherein the acidic, ion-exchange resin is a macroreticular ion-exchange resin.

Embodiment 4. The method of any one of the previous embodiments, wherein the acidic, ion-exchange resin is a copolymer of styrene and divinylbenzene, such as a cross-linked styrene and divinylbenzene copolymer.

Embodiment 5. The method of any one of the previous embodiments, wherein the acidic, ion-exchange resin has a concentration of acidic ion-exchange groups of at least about 1 milli-equivalent $H^+$ per gram dry resin.

Embodiment 6. The method of any one of the previous embodiments, wherein the provided fuel exhibits a pressure drop of at least about 20 mmHg, according to ASTM D3241.

Embodiment 7. The method of any one of the previous embodiments, wherein the provided fuel contacts the acidic, ion-exchange resin at an average liquid hourly space velocity from about 0.1 $hr^{-1}$ to about 10 $hr^{-1}$.

Embodiment 8. The method of any one of the previous embodiments, wherein the provided fuel comprises or is a jet fuel.

Embodiment 9. The method of any one of the previous embodiments, wherein the provided fuel has an ASTM D86 10% boiling point from about 110° C. to about 190° C., and an ASTM D86 90% boiling point from about 200° C. to about 290° C.

Embodiment 10. The method of any one of the previous embodiments, wherein the provided fuel has a Saybolt color of not greater than 20.

Embodiment 11. The method of any one of the previous embodiments, wherein the provided fuel is contacted with the acidic, ion-exchange resin at a temperature from about 10° C. to about 100° C.

Embodiment 12. The method of any one of the previous embodiments, wherein the provided fuel is treated to reduce mercaptan content prior to contact with the acidic, ion-exchange resin.

Embodiment 13. The method of embodiment 12, wherein the mercaptan-reduced fuel is water washed prior to contact with the acidic, ion-exchanged resin.

Embodiment 14. The method of any one of embodiments 1-11, wherein the provided fuel is treated with an alkaline composition in the presence of a mercaptan oxidation catalyst to produce a mercaptan-reduced product, and the mercaptan-reduced product is then contacted with the acidic, ion-exchanged resin.

EXAMPLES

This invention is illustrated in greater detail by the specific examples presented below. It is understood that these examples are to be considered as specific examples or embodiments of the overall aspect of the invention as claimed.

Example 1

Example 1 presents the properties of the Jet A-1 fuels (Jet 1 and Jet 2) produced with approximately 57 vol % heavy Canadian crude in the crude slate. Table 1 shows that the exemplary Jet 1 and Jet 2 type fuels are essentially equivalent. They both have low Saybolt color and poor JFTOT stability. The pressure drop for Jet 1 and Jet 2 hit about 25 mmHg after about 31 and about 24 minutes, respectively, into the JFTOT run.

TABLE 1

| | CAN/CGSB-3.23 Spec | | | |
|---|---|---|---|---|
| | Jet 1 | Jet 2 | Min | Max |
| Properties | | | | |
| Density @ 15° C., kg/m$^3$ | 834 | — | 775 | 840 |
| Saybolt Color | 17 | 14 | 12 | |
| Total Nitrogen, mg/L | 9 | 10 | — | — |
| Total Sulfur, wppm | 2390 | 2330 | | 3000 |
| JFTOT @ 275° C. | | | | |
| Pressure Drop, mmHg | >25 | >25 | | 25 |
| Tube Deposit Rating | <4P | <4P | <3 | |
| Result | fail | fail | pass | |

Example 2

Example 2 compares the effect of alumina catalyst against an acidic, ion-exchange catalyst, Amberlyst® 15, on Saybolt color quality and JFTOT thermal stability (pressure drop and tube deposit rating). The results are summarized in Table 2. Although similar Saybolt color and JFTOT results can be obtained with alumina and Amberlyst® 15, the Amberlyst® 15 sample required only about 4 hours shaking time (contact time) to exhibit the reported characteristics, versus about 26 hours for the alumina. Additionally, as little as about 0.5 grams of Amberlyst® 15 was effectively used, versus a significantly greater amount of about 1.5 grams of the alumina, in order to attain similar effectiveness.

These results showed superior effectiveness of the Amberlyst® 5 versus the alumina, and it is expected that similar acidic, ion-exchange resins would provide substantially the same result. Additionally, since the structures of an acidic, ion-exchange resin (such as Amberlyst® 15) and an alumina catalyst are substantially dissimilar, it could not have been reasonably expected that an acidic, ion-exchanged resin would have had such an effect.

In carrying out this example, the acidic, ion-exchanged resin was first activated. Specifically, about five grams of Amberlyst® 15 resin was covered with deionized water. The slurry of the water and resin was swirled for about 2 minutes at ambient temperature (about 20-25° C.). The water was then decanted and replaced with isopropanol. The isopropanol slurry was swirled, and the isopropanol then removed by decantation. The resin was then dried with a stream of nitrogen and dried in an oven at about 60° C. prior to use.

TABLE 2

| | Jet 1 | Jet 1 | Jet 2 | Jet 2 | Jet 2 |
|---|---|---|---|---|---|
| Adsorbent | None | Alumina A-2 | None | Amberlyst ® 15 | Amberlyst ® 15 |
| Adsorbent/Jet Fuel | None | 1.5 gm/45 mL | None | 1.35 gm/45 mL | 0.5 gm/45 mL |
| Shaking Time, hrs | None | 26 | None | 4 | 4 |
| Saybolt Color | 17 | >30 | 14 | >30 | 28 |
| Total Nitrogen, mg/L | 9 | <1 | 10 | <1 | <1 |
| Total Sulfur, wppm | 2390 | 2190 | 2330 | 2290 | 2320 |
| JFTOT @ 275° C. | | | | | |
| Pressure Drop, mmHg | >25 | 0.3 | >25 | — | 0.3 |
| Tube Deposit Rating | <4P | 1 | <4P | — | 2 |
| Result | fail | pass | fail | — | pass |

Example 3

Example 3 shows another side-by-side comparison of the alumina catalyst and the acidic, ion-exchanged resin. In both cases, jet fuel was treated with adsorbent to a target Saybolt color of about 21 and about 26-28. The comparison of the treated jet fuel to Saybolt color ~21 in Table 3 shows that Jet 1 treated with acidic, ion-exchanged resin had a significantly improved JFTOT (no observable pressure drop) although the JFTOT test failed on tube deposit rating. On the other hand, when the jet fuel was treated to a Saybolt color ~26-28, the acidic, ion-exchanged resin had significantly improved JFTOT for both pressure drop and tube deposit rating.

TABLE 3

| | Jet 1 | Jet 2 | Jet1 | Jet 1 | Jet 1 | Jet 2 |
|---|---|---|---|---|---|---|
| Adsorbent | None | None | Alumina | Amberlyst ® 15 | Alumina | Amberlyst ® 15 |
| Saybolt Color | 17 | 14 | 21 | 20 | 26 | 28 |
| Total Nitrogen mg/L | 9 | 10 | 9 | <1 | 1.6 | <1 |
| Total Sulfur, wppm | 2390 | 2330 | 2260 | 2280 | 2280 | 2320 |
| JFTOT @ 275° C. | | | | | | |
| Pressure Drop, mmHg | >25 | >25 | >25[1] | 0 | >25[2] | 0.2 |
| Tube Deposit rating | <4P | <4P | 4P | <4P | <4 | 2 |
| Result | fail | fail | fail | fail | fail | pass |

[1]Pressure reached 25 mmHg after about 28 minutes into the JFTOT run.

[2]Pressure reached 25 mmHg after about 11 minutes into the JFTOT run.

Example 4

Tables 4a and Table 4b illustrate the effectiveness of the acidic, ion-exchanged resin to improve the Saybolt color. Fresh acidic, ion-exchanged resin was used in Test #1. The acidic, ion-exchanged resin was then washed with methanol to remove residual fuel and dried with a stream of nitrogen (and not re-activated). The Saybolt color was improved from about 14 to >30 in about 4 hours. On re-using this resin without reactivation, about 17 hours were required to improve the Saybolt color to about 28. It was then used in Test #2. The acidic, ion-exchanged resin used in Test #2 was washed with methanol, dried with nitrogen, and re-used in Tests # 3, 4, and 5 (Table 4b).

TABLE 4a

| Impact of Shaking Time | | | |
|---|---|---|---|
| | Jet 2 | Test 1 | Test 2 |
| Adsorbent | None | Amberlyst ® 15 | Amberlyst ® 15 |
| Adsorbent/Jet Fuel | None | 1.35 g/45 mL | 1.35 g/45 mL |
| Shaking Time, hrs | None | 4 | 17 |
| Saybolt Color | 14 | +30 | 28 |

TABLE 4b

| Impact of Adsorbent/Fuel Ratio | | | | |
|---|---|---|---|---|
| | Jet 2 | Test 3 | Test 4 | Test 5 |
| Adsorbent | None | Amberlyst ® 15 | Amberlyst ® 15 | Amberlyst ® 15 |
| Adsorbent/Jet Fuel | None | 0.5 g/40 mL | 0.9 g/40 mL | 1.3 g/40 mL |
| Shaking Time, hrs | None | 1 | 1 | 1 |
| Saybolt Color | 14 | 21 | 24 | 27 |

Table 4b demonstrates the impact of adsorbent to jet fuel ratio for color improvement. A relatively small acidic, ion-exchanged resin to fuel ratio (e.g. about 0.5 grams to about 45 mL) still provided significant color improvement in a shaking experiment over the course of about 1 hour.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A process for increasing color quality and thermal stability of a jet fuel, comprising:

providing the jet fuel, wherein the jet fuel has an ASTM D86 10% boiling point from about 110° C. to about 190° C., an ASTM D86 90% boiling point from about 200° C. to about 290° C.; and a Saybolt color of not greater than 20; and contacting the jet fuel with an acidic, ion-exchange resin thereby increasing the color quality of the jet fuel by at least 10% in accordance with ASTM D156 and increasing the thermal stability of the jet fuel by at least 10% in accordance with ASTM D3241;

wherein the provided jet fuel is treated to reduce mercaptan content prior to contact with the acidic, ion-exchange resin.

2. The method of claim 1, wherein the acidic, ion-exchange resin is a sulfonic or phosphonic ion-exchanged resin.

3. The method of claim 1, wherein the acidic, ion-exchange resin is a macro-reticular ion-exchange resin.

4. The method of claim 1, wherein the acidic, ion-exchange resin is a copolymer of styrene and divinylbenzene.

5. The method of claim 1, wherein the acidic, ion-exchange resin is a cross-linked styrene and divinylbenzene copolymer.

6. The method of claim 1, wherein the acidic, ion-exchange resin has a concentration of acidic ion-exchange groups of at least about 1 milli-equivalent $H^+$ per gram dry resin.

7. The method of claim 1, wherein the provided jet fuel exhibits a pressure drop of at least 20 mmHg, according to ASTM D3241.

8. The method of claim 1, wherein the provided jet fuel contacts the acidic, ion-exchange resin at an average liquid hourly space velocity from about 0.1 $hr^{-1}$ to about 10 $hr^{-1}$.

9. The method of claim 1, wherein the provided jet fuel is contacted with the acidic, ion-exchange resin at a temperature from about 10° C. to about 100° C.

10. The method of claim 1, wherein the mercaptan-reduced jet fuel is water washed prior to contact with the acidic, ion-exchanged resin.

11. The method of claim 1, wherein the provided jet fuel is treated to reduce mercaptan content prior to contact with the acidic, ion-exchange resin by treating with an alkaline composition in the presence of a mercaptan oxidation catalyst to produce a mercaptan-reduced product.

* * * * *